US007669850B1

(12) United States Patent
Miller

(10) Patent No.: US 7,669,850 B1
(45) Date of Patent: Mar. 2, 2010

(54) MULTI-BALL ROULETTE

(76) Inventor: Gary Miller, 3655 Rawhide Ct., Las Vegas, NV (US) 89120

( * ) Notice: Subject to any disclaimer, the term of this patent is extended or adjusted under 35 U.S.C. 154(b) by 901 days.

(21) Appl. No.: 10/940,227

(22) Filed: Sep. 13, 2004

Related U.S. Application Data

(60) Provisional application No. 60/510,723, filed on Oct. 10, 2003.

(51) Int. Cl.
*A63B 71/00* (2006.01)

(52) U.S. Cl. ..... 273/143 R

(58) Field of Classification Search ..... 273/138.1, 273/143, 274
See application file for complete search history.

(56) References Cited

U.S. PATENT DOCUMENTS

| | | | | | |
|---|---|---|---|---|---|
| 1,376,199 | A | * | 4/1921 | Gotsche | 273/142 R |
| 4,185,828 | A | | 1/1980 | Fernandez | |
| 4,206,921 | A | | 6/1980 | Lüehr | |
| 4,321,673 | A | | 3/1982 | Hawwass et al. | |
| 4,391,442 | A | * | 7/1983 | Levy | 273/142 E |
| 4,601,470 | A | | 7/1986 | Kadota et al. | |
| 4,884,810 | A | | 12/1989 | Tiyony | |
| 4,906,005 | A | | 3/1990 | Manabe | |
| 4,989,873 | A | | 2/1991 | Manabe | |
| 5,022,654 | A | | 6/1991 | Berger | |
| 5,102,135 | A | | 4/1992 | Addiechi | |
| 5,259,616 | A | | 11/1993 | Bergmann | |
| 5,553,851 | A | * | 9/1996 | Malavazos et al. | 273/142 E |
| 5,636,838 | A | * | 6/1997 | Caro | 273/142 E |
| 5,755,440 | A | * | 5/1998 | Sher | 273/142 E |
| 5,857,909 | A | | 1/1999 | Rubin | |
| 5,934,999 | A | | 8/1999 | Valdez | |
| 6,083,105 | A | | 7/2000 | Ronin et al. | |
| 6,209,869 | B1 | * | 4/2001 | Mathews | 273/138.1 |
| 6,227,542 | B1 | | 5/2001 | Cosmi | |
| 6,283,856 | B1 | | 9/2001 | Mothwurf | |

* cited by examiner

*Primary Examiner*—Gene Kim
*Assistant Examiner*—Dolores Collins
(74) *Attorney, Agent, or Firm*—Robert Ryan Morishita; Morishita Law Firm, LLC

(57) ABSTRACT

A selection mechanism such as a Roulette wheel determines at least two outcomes for each game. Players are permitted in various embodiments to wager on the various outcomes with betting options such as a second chance wager, an enhanced wager, a combination wager, sequenced or non-sequenced, or the like. After determination of the two outcomes, losing wagers are collected and winning wagers are rewarded according to a predetermined pay table.

13 Claims, 14 Drawing Sheets

Figure 2

| Award Schedules | | | | | |
|---|---|---|---|---|---|
| Standard Game Betting Odds | | | | Multi-Ball Game Betting Odds | |
| Bet | One-ball Odds | | Bet | 1st Ball Odds | 2nd Ball Odds |
| Single Number | 35 to 1 | | Single Number | 35 to 1 | 17 to 1 |
| Two Numbers | 17 to 1 | | Two Numbers | 17 to 1 | 8 to 1 |
| Three Numbers | 11 to 1 | | Three Numbers | 11 to 1 | 5 to 1 |
| Four Numbers | 8 to 1 | | Four Numbers | 8 to 1 | 4 to 1 |
| Five Numbers | 6 to 1 | | Five Numbers | 6 to 1 | 3 to 1 |
| Six Numbers | 5 to 1 | | Six Numbers | 5 to 1 | 2 to 1 |
| Column | 2 to 1 | | Column | 2 to 1 | 1 to 1 |
| Dozen | 2 to 1 | | Dozen | 2 to 1 | 1 to 1 |
| Odd/Even | 1 to 1 | | Odd/Even | 1 to 1 | N/A |
| Black/Red | 1 to 1 | | Black/Red | 1 to 1 | N/A |
| High/Low | 1 to 1 | | High/Low | 1 to 1 | N/A |

Figure 3

| | | | | |
|---|---|---|---|---|
| | | 0 | 00 | |
| 1 to 18 | 1st 12 | 1 | 2 | 3 |
| | | 4 | 5 | 6 |
| EVEN | | 7 | 8 | 9 |
| | | 10 | 11 | 12 |
| RED | 2nd 12 | 13 | 14 | 15 |
| | | 16 | 17 | 18 |
| BLACK | | 19 | 20 | 21 |
| | | 22 | 23 | 24 |
| ODD | 3rd 12 | 25 | 26 | 27 |
| | | 28 | 29 | 30 |
| 19 to 36 | | 31 | 32 | 33 |
| | | 34 | 35 | 36 |
| | | | | |

Figure 4

| Award Schedules | | | | | |
|---|---|---|---|---|---|
| Standard Game Betting Odds | | | Multi-Ball Game Betting Odds | | |
| Bet | One-ball Odds | Bet | 1st Ball Odds | 2nd Ball Odds | |
| Single Number | 35 to 1 | Single Number | 35 to 1 | 37 to 1 | 36 to 1 |
| Two Numbers | 17 to 1 | Two Numbers | 17 to 1 | 19 to 1 | 18 to 1 |
| Three Numbers | 11 to 1 | Three Numbers | 11 to 1 | 13 to 1 | 12 to 1 |
| Four Numbers | 8 to 1 | Four Numbers | 8 to 1 | 10 to 1 | 9 to 1 |
| Five Numbers | 6 to 1 | Five Numbers | 6 to 1 | 8 to 1 | 7 to 1 |
| Six Numbers | 5 to 1 | Six Numbers | 5 to 1 | 7 to 1 | 6 to 1 |
| Column | 2 to 1 | Column | 2 to 1 | 4 to 1 | 3 to 1 |
| Dozen | 2 to 1 | Dozen | 2 to 1 | 4 to 1 | 3 to 1 |
| Odd/Even | 1 to 1 | Odd/Even | 1 to 1 | 1 to 1 | 1 to 1 |
| Black/Red | 1 to 1 | Black/Red | 1 to 1 | 1 to 1 | 1 to 1 |
| High/Low | 1 to 1 | High/Low | 1 to 1 | 1 to 1 | 1 to 1 |

Figure 5

| | | | | | | | | | | | |
|---|---|---|---|---|---|---|---|---|---|---|---|
| | | | | 0 | 00 | | 0 | 00 | | | |
| 1 to 18 | 1 to 18 | 1st 12 | 1st 12 | 1 | 2 | 3 | 1 | 2 | 3 | 1st ball | 2nd ball |
| | | | | 4 | 5 | 6 | 4 | 5 | 6 | | |
| EVEN | EVEN | | | 7 | 8 | 9 | 7 | 8 | 9 | | |
| | | | | 10 | 11 | 12 | 10 | 11 | 12 | | |
| RED | RED | 2nd 12 | 2nd 12 | 13 | 14 | 15 | 13 | 14 | 15 | 1st ball | 2nd ball |
| | | | | 16 | 17 | 18 | 16 | 17 | 18 | | |
| BLACK | BLACK | | | 19 | 20 | 21 | 19 | 20 | 21 | | |
| | | | | 22 | 23 | 24 | 22 | 23 | 24 | | |
| ODD | ODD | 3rd 12 | 3rd 12 | 25 | 26 | 27 | 25 | 26 | 27 | 1st ball | 2nd ball |
| | | | | 28 | 29 | 30 | 28 | 29 | 30 | | |
| 19 to 36 | 19 to 36 | | | 31 | 32 | 33 | 31 | 32 | 33 | | |
| | | | | 34 | 35 | 36 | 34 | 35 | 36 | | |

Figure 6

| Award Schedules | | | | |
|---|---|---|---|---|
| Standard Game Betting Odds | | | Multi-Ball Game Betting Odds | |
| Bet | One-ball Odds | Bet | 1st Ball Odds | 2nd Ball Odds |
| Single Number | 35 to 1 | Single Number | 35 to 1 | 38 to 1 |
| Two Numbers | 17 to 1 | Two Numbers | 17 to 1 | 18 to 1 |
| Three Numbers | 11 to 1 | Three Numbers | 11 to 1 | 12 to 1 |
| Four Numbers | 8 to 1 | Four Numbers | 8 to 1 | 9 to 1 |
| Five Numbers | 6 to 1 | Five Numbers | 6 to 1 | 6 to 1 |
| Six Numbers | 5 to 1 | Six Numbers | 5 to 1 | 5 to 1 |
| Column | 2 to 1 | Column | 2 to 1 | 2 to 1 |
| Dozen | 2 to 1 | Dozen | 2 to 1 | 2 to 1 |
| Odd/Even | 1 to 1 | Odd/Even | 1 to 1 | 1 to 1 |
| Black/Red | 1 to 1 | Black/Red | 1 to 1 | 1 to 1 |
| High/Low | 1 to 1 | High/Low | 1 to 1 | 1 to 1 |

Figure 7

| Award Schedules | | | | | |
|---|---|---|---|---|---|
| Standard Game Betting Odds | | | Multi-Ball Game Betting Odds | | |
| Bet | One-ball Odds | Bet | 1st Ball Odds | 2nd Ball Odds | Combo Odds |
| Single Number | 35 to 1 | Single Number | 35 to 1 | 36 to 1 | 1200 to 1 |
| Two Numbers | 17 to 1 | Two Numbers | 17 to 1 | 18 to 1 | 600 to 1 |
| Three Numbers | 11 to 1 | Three Numbers | 11 to 1 | 12 to 1 | 400 to 1 |
| Four Numbers | 8 to 1 | Four Numbers | 8 to 1 | 9 to 1 | 300 to 1 |
| Five Numbers | 6 to 1 | Five Numbers | 6 to 1 | 7 to 1 | 240 to 1 |
| Six Numbers | 5 to 1 | Six Numbers | 5 to 1 | 6 to 1 | 200 to 1 |
| Column | 2 to 1 | Column | 2 to 1 | 3 to 1 | 100 to 1 |
| Dozen | 2 to 1 | Dozen | 2 to 1 | 3 to 1 | 100 to 1 |
| Odd/Even | 1 to 1 | Odd/Even | 1 to 1 | 1 to 1 | 60 to 1 |
| Black/Red | 1 to 1 | Black/Red | 1 to 1 | 1 to 1 | 60 to 1 |
| High/Low | 1 to 1 | High/Low | 1 to 1 | 1 to 1 | 60 to 1 |

Figure 8

Non-Sequence Bet

| 1 to 18 | 1 to 18 | 1st 12 | 1st 12 | 1 | 2 | 3 | 1 | 2 | 3 |
|---|---|---|---|---|---|---|---|---|---|
| | | | | 4 | 5 | 6 | 4 | 5 | 6 |
| EVEN | EVEN | | | 7 | 8 | 9 | 7 | 8 | 9 |
| | | | | 10 | 11 | 12 | 10 | 11 | 12 |
| RED | RED | 2nd 12 | 2nd 12 | 13 | 14 | 15 | 13 | 14 | 15 |
| | | | | 16 | 17 | 18 | 16 | 17 | 18 |
| BLACK | BLACK | | | 19 | 20 | 21 | 19 | 20 | 21 |
| | | | | 22 | 23 | 24 | 22 | 23 | 24 |
| ODD | ODD | 3rd 12 | 3rd 12 | 25 | 26 | 27 | 25 | 26 | 27 |
| | | | | 28 | 29 | 30 | 28 | 29 | 30 |
| 19 to 36 | 19 to 36 | | | 31 | 32 | 33 | 31 | 32 | 33 |
| | | | | 34 | 35 | 36 | 34 | 35 | 36 |
| 1st ball | 2nd ball | 1st ball | 2nd ball | 1st ball | 1st ball | 1st ball | 2nd ball | 2nd ball | 2nd ball |

| 0 | 00 | 0 | 00 |
|---|---|---|---|

Figure 9

| Award Schedules | | | | | | |
|---|---|---|---|---|---|---|
| Standard Betting Odds | | | Multi-Ball Game Betting Odds | | | |
| Bet | Odds | Bet | 1st Ball Odds | 2nd Ball Odds | Sequenced Odds | Non-Seq. Odds |
| 1 Number | 35 to 1 | 1 Number | 35 to 1 | 36 to 1 | 1200 to 1 | 600 to 1 |
| 2 Numbers | 17 to 1 | 2 Numbers | 17 to 1 | 18 to 1 | 300 to 1 | 150 to 1 |
| 3 Numbers | 11 to 1 | 3 Numbers | 11 to 1 | 12 to 1 | 130 to 1 | 65 to 1 |
| 4 Numbers | 8 to 1 | 4 Numbers | 8 to 1 | 9 to 1 | 75 to 1 | 35 to 1 |
| 5 Numbers | 6 to 1 | 5 Numbers | 6 to 1 | 7 to 1 | 45 to 1 | 22 to 1 |
| 6 Numbers | 5 to 1 | 6 Numbers | 5 to 1 | 6 to 1 | 30 to 1 | 15 to 1 |
| Column | 2 to 1 | Column | 2 to 1 | 3 to 1 | 7 to 1 | 3 to 1 |
| Dozen | 2 to 1 | Dozen | 2 to 1 | 3 to 1 | 7 to 1 | 3 to 1 |
| Odd/Even | 1 to 1 | Odd/Even | 1 to 1 | 1 to 1 | 3 to 1 | 1 to 1 |
| Black/Red | 1 to 1 | Black/Red | 1 to 1 | 1 to 1 | 3 to 1 | 1 to 1 |
| High/Low | 1 to 1 | High/Low | 1 to 1 | 1 to 1 | 3 to 1 | 1 to 1 |

MultiBall Roulette Betting Field With Combinations

Figure 11

MULTI-BALL ROULETTE COMBINATION BETTING PAYOFF TABLE
Based on number of outcomes included in each wager category selected Sequenced Bets

| Category of Second Wager | Category of First Wager: 1 | 2 | 3 | 4 | 5 | 6 | 12 | 18 |
|---|---|---|---|---|---|---|---|---|
| 1 | 1200 | 600 | 400 | 300 | 240 | 200 | 100 | 60 |
| 2 | 600 | 300 | 200 | 150 | 120 | 100 | 50 | 30 |
| 3 | 400 | 200 | 130 | 100 | 80 | 65 | 30 | 20 |
| 4 | 300 | 150 | 100 | 75 | 60 | 50 | 25 | 15 |
| 5 | 240 | 120 | 80 | 60 | 45 | 40 | 20 | 12 |
| 6 | 200 | 100 | 65 | 50 | 40 | 30 | 15 | 10 |
| 12 | 100 | 50 | 30 | 25 | 20 | 15 | 7 | 5 |
| 18 | 60 | 30 | 20 | 15 | 12 | 10 | 5 | 3 |

Non-Sequenced Bets

| Category of Second Wager | Category of First Wager: 1 | 2 | 3 | 4 | 5 | 6 | 12 | 18 |
|---|---|---|---|---|---|---|---|---|
| 1 | 600 | 300 | 200 | 150 | 120 | 100 | 50 | 30 |
| 2 | 300 | 150 | 100 | 75 | 60 | 50 | 25 | 15 |
| 3 | 200 | 100 | 65 | 50 | 40 | 30 | 15 | 10 |
| 4 | 150 | 75 | 50 | 35 | 30 | 25 | 12 | 7 |
| 5 | 120 | 60 | 40 | 30 | 22 | 20 | 10 | 6 |
| 6 | 100 | 50 | 30 | 25 | 20 | 15 | 7 | 5 |
| 12 | 50 | 25 | 15 | 12 | 10 | 7 | 3 | 2 |
| 18 | 30 | 15 | 10 | 7 | 6 | 5 | 2 | 1 |

Figure 12

| | | | | | | | | | | | |
|---|---|---|---|---|---|---|---|---|---|---|---|
| | | | | | | 0 | 00 | HOUSE | | 00 | 0 |
| | | | 1st 12 | 1st 12 | 1st 12 | 1 | 28 | 2 | 29 | 3 | 30 |
| Red | Red | Red | 1st 12 | 2nd 12 | 3rd 12 | 4 | 16 | 5 | 17 | 6 | 18 |
| Blk | Blk | Blk | 1st 12 | 2nd 12 | 3rd 12 | 7 | 13 | 8 | 14 | 9 | 15 |
| Red | Red | Red | 1st 12 | 2nd 12 | 3rd 12 | 10 | 1 | 11 | 2 | 12 | 3 |
| 1 to 18 | 1 to 18 | 19 to 36 | 2nd 12 | 2nd 12 | 2nd 12 | 13 | 19 | 14 | 20 | 15 | 21 |
| 19 to 36 | 19 to 36 | 1 to 18 | 2nd 12 | 2nd 12 | 2nd 12 | 16 | 31 | 17 | 32 | 18 | 33 |
| 1 to 18 | 1 to 18 | 19 to 36 | 2nd 12 | 2nd 12 | 2nd 12 | 19 | 7 | 20 | 8 | 21 | 9 |
| 19 to 36 | 19 to 36 | 1 to 18 | 2nd 12 | 2nd 12 | 2nd 12 | 22 | 34 | 23 | 35 | 24 | 36 |
| Odd | Odd | Even | 3rd 12 | 3rd 12 | 3rd 12 | 25 | 4 | 26 | 5 | 27 | 6 |
| Even | Even | Odd | 3rd 12 | 3rd 12 | 3rd 12 | 28 | 10 | 29 | 11 | 30 | 12 |
| Odd | Odd | Even | 3rd 12 | 3rd 12 | 3rd 12 | 31 | 25 | 32 | 26 | 33 | 27 |
| Even | Even | Odd | 3rd 12 | 3rd 12 | 3rd 12 | 34 | 22 | 35 | 23 | 36 | 24 |

Figure 13

| Category of outcome selected | Payoff if sequential | Payoff if non-sequential |
|---|---|---|
| →→ HOUSE outcome ←← | **1400** | 600 |
| Single pair of outcomes | 1200 | 600 |
| Two pairs of outcome | 600 | 300 |
| Row of 3 pairs of outcome | 400 | 200 |
| Corner of 4 pair of outcome | 300 | 150 |
| Edge corner of 5 pair of outcome | 240 | 120 |
| Edge corner of 6 pair of outcome | 200 | 100 |
| Paired groups of 12 | 7 | 2 |
| Paired groups of 18 | 3 | 1 |

MultiBall Routette Award Schedule

MULTI-BALL ROULETTE

RELATED APPLICATION DATA

The present application claims the priority of U.S. Provisional Application Ser. No. 60/510,723 entitled "Multi-Ball Roulette," filed Oct. 10, 2003 by Applicant herein.

FIELD OF THE INVENTION

The present invention relates to gaming methods. Specifically, the present invention is a method for modifying a casino game, such as Roulette, to expand the number of potential outcomes and betting options by generating, and allowing wagering on, multiple outcomes in each game occurrence.

BACKGROUND OF THE INVENTION

Roulette is a well known casino game played using a rotatable Roulette wheel with pockets or canoes around its periphery. Each canoe is separated from an adjacent canoe by a separator or fret. The canoes are marked with numbers 1-36 with an additional canoe for 0 in the European version and two additional canoes for 0 and 00 in the American version. Each of the numbers 1-36 are colored either red or black such that eighteen of the numbers are red and eighteen are black. The canoe marked 0 is colored green as, in the American version, is the canoe marked 00. Adjacent canoes are given non-consecutive numbers, no two adjacent canoes have matching colors, and, in the American version, 0 and 00 are diametrically opposite positions on the wheel.

The wheel is set inside of a bowl-shaped enclosure in which the Roulette ball can be launched, spinning about the bowl, until friction and gravity force it to slow and descend to the wheel. The enclosure may have tracks and/or projections to control and randomize motion of the Roulette ball until it comes to rest in one of the canoes.

The wheel assembly is mounted on a gaming table covered with a layout having areas marked with numbers corresponding to the numbers on the Roulette wheel. By positioning chips inside numbered wagering areas or along borders or intersections of numbered wagering areas, players may place wagers on one or more numbers. The layout also includes proposition wagers on subsets of numbers such as odd, even, black, red, high, low, dozen (1st 12, 2nd 12, or 3rd 12), and column.

To play the game, players place chips on one or more wagering areas and a ball is launched into the Roulette enclosure. The ball eventually comes to rest in a canoe of the Roulette wheel and determines the winning number and proposition wagers. Wagers on a winning number, group of numbers, or proposition are rewarded based on the nature of the wager. Winning wagers on a single number are typically rewarded at 35 to 1; winning wagers on two numbers are typically rewarded at 17 to 1; winning wagers on three numbers are typically rewarded at 11 to 1; willing wagers on four numbers are typically rewarded at 8 to 1; winning wagers on five numbers are typically rewarded at 6 to 1; winning wagers on six numbers are typically rewarded at 5 to 1; winning dozen and column wagers are typically rewarded at 2 to 1; and winning odd, even, black, red, high, and low wagers are typically rewarded at 1 to 1 or even money.

The traditional game of Roulette does have some drawbacks. The highest payout is typically set to 35 to 1. Players want the thrill of higher potential rewards. Slot machines and video poker have their highest payouts at no less than several hundred to one, and in some of the progressive slots games, these odds may be millions to one. While games such as blackjack and craps may have the same drawback, their play is much faster, and so a player is able to wager more times per hour, and generate more excitement.

On the other extreme, players may see the likelihood of hitting a single number as being a long-shot, and want the option of a "second chance" bet, so that if they lose the first chance, they still may come out ahead. This is analogous to betting a horse to place or show, where a player has more than one opportunity to win. Players often see such betting mechanisms as improving their odds, and allow them to play more conservatively, and often to play for a longer period of time.

It can be seen, therefore, that there is a need in the art for a Roulette game that affords players both higher payout odds and additional opportunities to win. However, with the long history of the game of Roulette, it would he inadvisable to change the game in a way which lost the traditional structure of the wheel and the essence of the wagering layouts. Ideally, the Roulette wheel itself would not be changed, and the player would be able to continue to make the same wagers as were available in the traditional embodiment, but have exciting new options available as well.

For example, U.S. Pat. No. 6,209,869, issued to Matthews, discloses a multi-ball option for Roulette in which the wheel permits the simultaneous play of multiple balls, of distinct colors, and in which players may wager on the result of a single selected ball, the result of all of the balls, or the result of all-but-one of the balls. Thus, in the four-ball embodiment, a play may wager that the "green" ball will land on the number 7, that all four will land on the number 7, or that three of the four will land on the number 7.

However, the game of Mathews has drawbacks. First, the multiple balls used are distinct, but not sequential. This limits the betting options available.

Second, the player is limited to betting on a single result, and cannot, for example, bet that the four balls will land on 7, 11, 19, and 70, perhaps the favorite bet for a player born on Jul. 11, 1970.

Third, except in the two-ball version, the player may not bet that one of the balls will get a specific result without picking which ball, or making the same wager individually on each of the balls.

Fourth, the player may not combine bets of different types, for example, betting that the first result will be even, the second will be a 7, and the third will be red.

Fifth, as the same result may occur on multiple balls, other than the "all-but-one" wager, the Mathews gambling enhancement is logically indistinguishable from simply letting a wager "ride" through several spins of the Roulette wheel.

Thus, it can be seen that there is a need in the art for a modified version of Roulette that simultaneously provides for larger payouts from a single game, gives the less aggressive player the chance to "hedge his bets," and yet does not drastically change the look and feel of the game.

SUMMARY OF THE INVENTION

The present invention is a Roulette game played using a traditional Roulette wheel, or an electronic representation thereof, that begins with a player making at least one wager. Between the placing of the wager and the resolution of the wager, at least two sequenced, non-repetitive number outcomes are obtained by launching at least two, visually distinguishable, game balls into the Roulette wheel. The several Roulette balls are designated a "first" ball, and "second" ball, etc. The winning outcomes would be determined by the several canoes in which these game balls came to rest, a different canoe for each ball.

The present method could take a number of different embodiments. For example, in one optional embodiment, a player makes a single wager. The first outcome is resolved as in conventional Roulette. Subsequent outcomes are "second chance" outcomes that result in a reward, optionally a reduced reward, to a player who did not receive a winning outcome on the first game ball.

In another optional embodiment, a player may increase his wager in exchange for eligibility to obtain a higher payout for receiving a winning outcome on a subsequent game ball. In such an optional embodiment, the player may be wagering on the same outcome for both the multiple game balls. Players are optionally only rewarded for the highest payout obtained. Thus, if the wagers on a single number and wins on a first game ball and loses on a second game ball, he loses half his wager but is rewarded on a first pay table on the remaining half of the wager; if the player wins on a second game ball, the player loses half his wager and is paid based on a second pay table, optionally at a greater rate than that of the first pay table, on the remaining half of the wager without regard to whether he wins or loses on the first game ball. However, if a player wagers on more than one number, he is eligible to be rewarded on a first wager on a first outcome and a second wager on a different second outcome.

In yet another optional embodiment, a second wagering field is provided. By placing a first wager on the first game ball, the player becomes eligible to place a second wager on the second game ball. Optionally, the player may or may not be restricted to select the same outcomes on the first and second game balls. Players are rewarded for the first and second outcomes independently; that is, a player winning on the first outcome is rewarded on a first pay table and a player winning on a second outcome is rewarded on a second pay table regardless of whether the player won or lost on the first outcome.

In another optional embodiment, a second wagering field is provided and each player must wager on a first outcome and a second outcome. In placing wagers, players may place optional supplemental wagers on whether the first and second outcomes will occur sequentially or non-sequentially. In one optional embodiment, players may be rewarded for only obtaining one of the two wagered outcomes; in an alternate optional embodiment, the player may be required to place an additional "one of two" wager to be eligible for such a reward.

In yet another optional embodiment, a customized wagering field is provided in which certain number outcomes are aligned with one another to provide matched first and second outcomes. In such an embodiment, players place wagers by placing a gaming chip on the border between a matched first and second outcome. Outcomes obtained in sequence may be rewarded at a higher rate than outcomes obtained out of sequence.

In yet one more embodiment, a customized wagering field is provided in which players may place wagers on a designated first outcome and an independently designated second outcome. The two selections need not be of the same category, and the payout for winning wagers would be determined by the categories of the successful selections. Optionally, the player may elect to have sequence of outcome disregarded, for which election the payout would be reduced.

As noted above, the present method could be embodied in an electrical, mechanical, electro-mechanical, or video gaming device.

BRIEF DESCRIPTION OF THE DRAWINGS

FIG. 2 is an example of a pay table for the embodiment of FIG. 1;

FIG. 3 is a plan drawing of a wagering field according to an optional embodiment of the present invention;

FIG. 4 is an example of a pay table for the embodiment of FIG. 3;

FIG. 5 is plan drawing of a wagering field according to an optional embodiment of the present invention;

FIG. 6 is an example of a pay table for the embodiment of FIG. 5;

FIG. 7 is an example of another pay table;

FIG. 8 is plan drawing of a wagering field according to an optional embodiment of the present invention;

FIG. 9 is an example of a pay table for the embodiment of FIG. 8;

FIG. 11 is an example of a pay table for the embodiment of FIG. 10;

FIG. 12 is plan drawing of a wagering field according to an optional embodiment of the present invention; and FIG. 13 is an example of a pay table for the embodiment of FIG. 12;

DESCRIPTION

Reference is now made to the figures wherein like parts are referred to by like numerals throughout. The present method is a Roulette game played on a Roulette wheel constructed with thirty-seven (in a European version) or thirty-eight (in an American version) numbered canoes around its periphery. Each canoe is separated from an adjacent canoe by a fret. The canoes are numbered 1-36 with additional canoes for 0 in a European version or 0 and 00 in an American version. The game could also be played on an electrical, mechanical, electro-mechanical, or video representation of a Roulette wheel.

Figure 14:
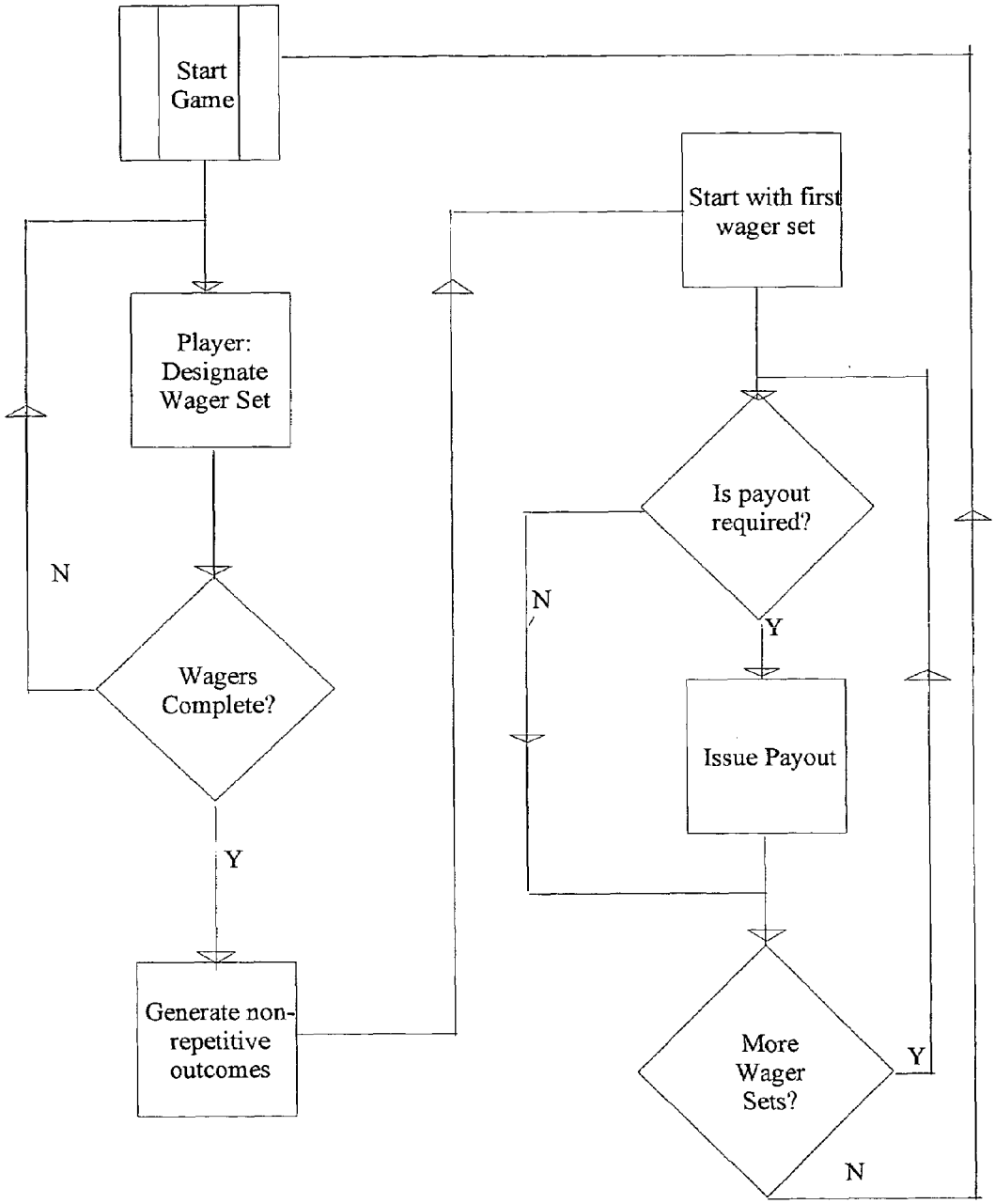
FIG. 14 is a flowchart of a method according to an embodiment of the present invention.

Referring generally to FIG. 14, the game begins with players making wagers in a manner described in more detail below. After players place wagers, at least two sequenced, non-repetitive number outcomes, a first outcome and a second outcome, are obtained by either launching a single game ball into the Roulette wheel two or more times or by simultaneously launching two or more game balls into the Roulette wheel. If multiple game balls are used, the game balls could be distinguished by color. Based on the first and second outcomes and the wagers placed by the players, wagers are collected or rewarded according to a predetermined pay table.

Figure 1:
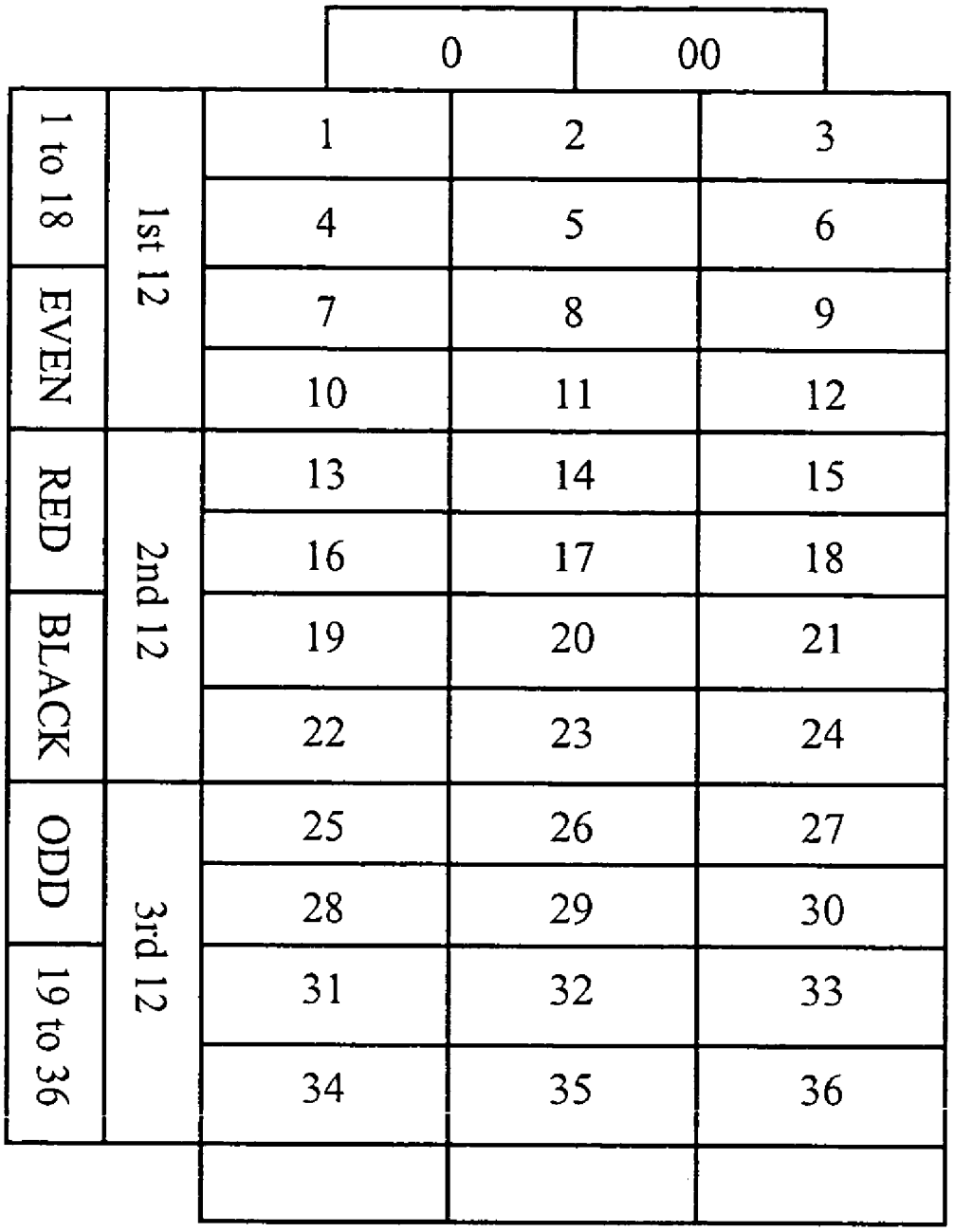
FIG. 1 is a plan drawing of a wagering field according to an optional embodiment of the present invention.

Turning to the specific wagers and pay tables that may be available, a number of embodiments are possible. Referring first to FIG. 1, in one optional embodiment, a conventional Roulette wagering field is provided. Players place a single wager on the wagering field in a selected wager area.

By placing a wager, a player receives an opportunity to receive a reward based on the first outcome from a first game ball and a "second chance" outcome from a subsequent game ball. In other words, the first ball outcome optionally pays according to a conventional Roulette pay table. The subsequent ball is considered a "second chance" ball. The payouts for the subsequent game ball are optionally less than the payouts for the first game ball, however, the player of such an optional embodiment does not have to place an additional wager to be rewarded for the obtaining a subsequent outcome. That is, the initial bet will serve as a wager for the first game ball as well as afford the player a second chance on the subsequent game ball if the first game ball did not provide a winning outcome. In such an optional embodiment players are only rewarded on one outcome, optionally the highest paid outcome.

For example, suppose a player places a wager on a row of three numbers. If the first outcome matches one of the selected numbers and the second outcome matches one of the two remaining selected numbers, the player will be rewarded on the first outcome only because the greatest payout was for obtaining a first outcome. The second outcome will not he rewarded. If in the same example, the first outcome did not match any of the three selected numbers, and the second outcome did match one of the three selected numbers, then a reward for the second outcome would be paid.

In an optional embodiment, the first and second wagers would be rewarded according to the following tables of FIG. 2 comparing the present invention to standard Roulette.

In another optional embodiment, a standard Roulette wagering field is again utilized. In such an embodiment, the player may increase his wager for the opportunity to participate in the multi-ball wager. The wager placed by the player is allocated with a portion on the selected outcomes for the first game ball and a portion on the same selected outcomes for the subsequent game ball. Optionally, the pay table for some of the payouts on the second game ball are more than the payouts on the corresponding bet on the first game ball such that the payout is the average of the first game ball wager and the second game ball wager per winning payout. For example, the payout for selecting and winning one of the thirty-eight numbered positions on the American roulette wheel is 35 to 1. In calculating the payout odds for the present multiple ball embodiment, one combines the 35 to 1 payout on the first game ball and the 37 to 1 payout for the same position bet on the second game ball to arrive at a payout of 36 to 1 per ball hit. Thus, if the player wagers one unit on the first outcome and one unit on the second outcome, a winning outcome would be rewarded at thirty six units for selecting a single number, however the player would lose one of the two original two units wagered, since only one game ball can win on a single number wager.

However, if a player wagers on a set of numbers all winning wagers will be rewarded. For example, suppose a player places his increased wager on a row of three numbers. If a first outcome matches one of the selected numbers and a second outcome matches one of the two remaining numbers, then both wagers are rewarded according to the pay table. Conversely, as alluded to above, if a player wins on only one game ball, the player loses the portion of his wager allocated to the first outcome and is paid on the remaining portion at the posted table award value. In one optional embodiment, the pay table of FIG. 4 is used.

In yet another embodiment, separate wagering fields and pay tables are used for each of the multiple game balls. As shown in FIG. 5, the wagering field contains two standard Roulette wagering fields optionally displayed together as a single expanded wagering field. In an optional embodiment, the wagering fields may be colored to distinguish wagers on the first game ball from those on the second game ball. Optionally, the second ball awards are a higher value than the first ball awards.

A player must place a bet on the first game ball to be eligible to place a bet on the second, although it is contemplated that a player may wager on the first ball only. Optionally, the pay table for the first outcome are the same as in conventional Roulette. While players may wager on any numbers to appear in the first and second outcomes, only wagers of the same value on the same numbers for both the first and second outcomes will be paid at a greater rate. For example, a five-dollar wager on a single number of 34 on the first ball and a separate five-dollar wager placed on the single number of 34 on the second ball is eligible for higher awards. All wagers are paid based on the actual amount wagered, as opposed to a portion of the value as in the previous embodiment. After first ball bets are paid, then second ball winning bets are paid at the higher values as indicated in the optional pay table of FIG. 6.

In a variation on the preceding embodiment, a single expanded wagering field is used for both first and second wagers. Once again, the player must wager on the first outcome to be eligible to wager on the second outcome. However, unlike the preceding embodiment, the player is not required to wager on the same number on the second wager but may choose to wager on a different number. However, all individual second game ball wager must be in the same category as the selected first game ball wager. For example, if a player places a first wager on the single number 34 he is qualified to select any of the single numbers for his second wager. Winning wagers would be rewarded as indicated in the optional pay table of FIG. 7.

In another optional embodiment, an expanded single wagering field such as that shown in FIG. 8 is utilized. In such an optional embodiment, however, players are required to place both first and second wagers; single ball wagers are not allowed. Again, players place wagers on the wagering fields for the first outcome and the second outcome. The first outcome wagered upon must be in the same category as the second outcome wagered upon.

In such an optional embodiment, players may place additional wagers to designate the sequence of the outcomes that may result in a higher reward. Optionally, combination marker chips are provided for players to identify such wagers. For example, a player who wishes to bet that the number 15 will occur on the first ball, and the number 10 will occur on the second would place a five dollar chip and a combination chip on the single number 15 in the first wagering field and a corresponding combination chip on the single number 10 on the second wagering field. This indicates that the player is betting that the first outcome of 15 and the second outcome of 10 will occur in sequence. Optionally each player may have several combination chips, specially marked to indicate which pairs of chips are to be considered together. Optionally either different combination chips would indicate a bet which would allowed the outcomes to occur in any sequence, or the combination chips could have indicators on each side, one for sequence, the other for non-sequence. Wagers are rewarded as shown in the optional pay table of FIG. 9.

Figure 10:
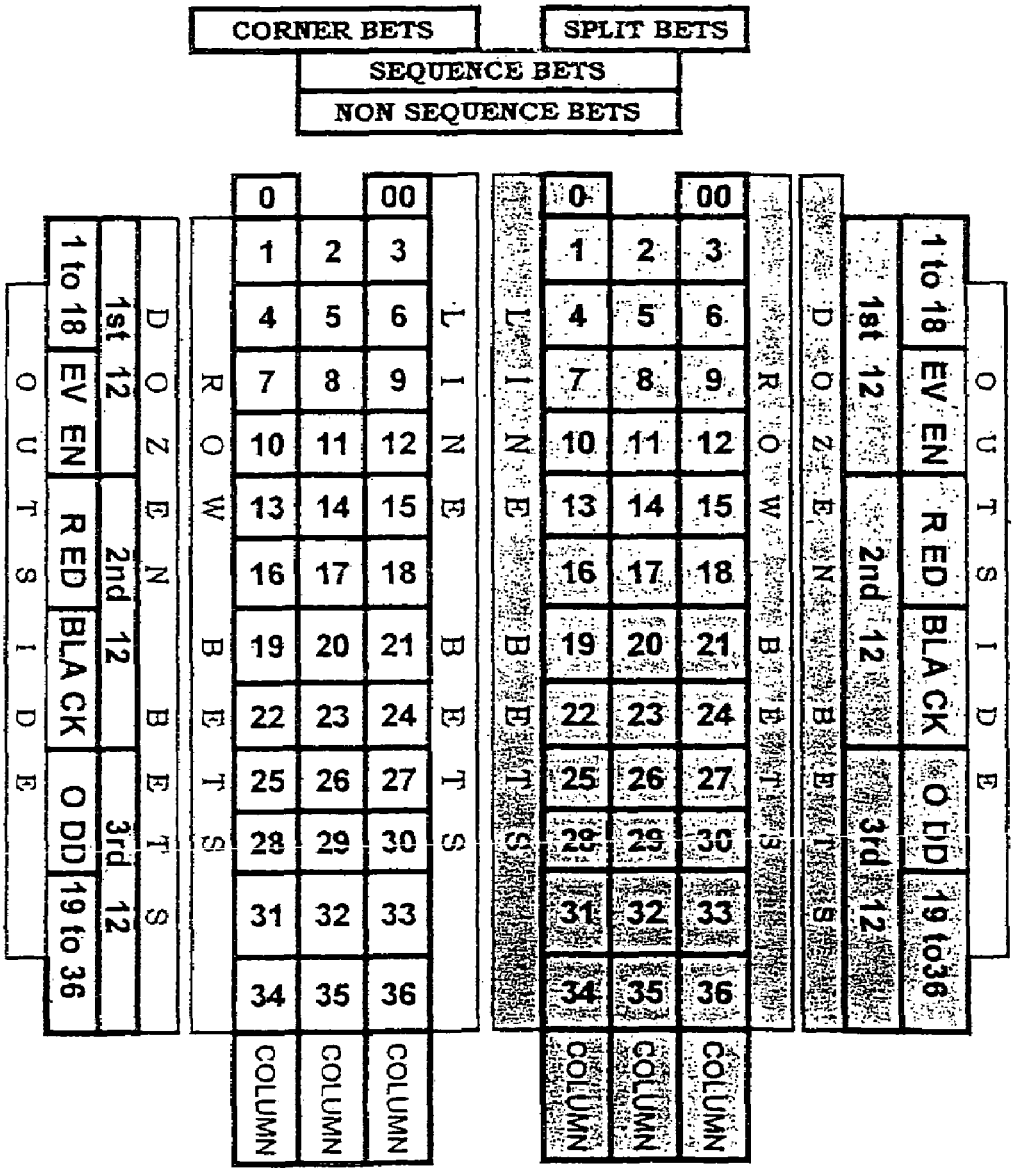
FIG. 10 is plan drawing of a wagering field according to an optional embodiment of the present invention.

In yet another embodiment shown in FIG. 10, a wagering field incorporating two complete conventional Roulette wagering fields is utilized with additional customized bet squares and betting areas. This game is a specific combination betting game. The player uses non-value marker chips specific to that player to designate "combination", "sequence" and "non-sequence" outcomes. In other words, these chips are used specifically to indicate the numbers or combinations the player chooses to bet. Bets of any categories may be combined.

Players place wagers for these selected combinations in the betting line area of the wagering field. Each individual wager is specific to one combination, either sequenced or non-sequenced, as denoted by the marker chips. In such an optional embodiment, players are not rewarded on individual first and second outcomes. In such an embodiment, rewards may be issued according to the optional pay table of FIG. 11.

For example, a player may have two designator chips each with a #1 imprinted on each side. These chips would have no value, but would be used to indicate the combination bet. Further, one side of the chips would be used to indicate a sequenced wager, and the other for a non-sequenced wager. The actual wager would be determined by placing normal chips under either of the indicator chips. If the player were to place one designator chip, "sequenced" side up, and a normal $5 chip, on the "1$^{st}$ 12" wager box in the first ball area, and the other such chip in the "26" box in the second ball area, also "sequenced" side up. If the outcomes "8" and "26" are generated, in sequence, the player would be rewarded at a rate of 400 to 1, or a total of $2,000. If non-sequenced had been selected, the payoff rate would be 200 to 1. If the sequence generated had been reversed, i.e. "26", then "8", a only the non-sequenced bet would be paid, at a rate of 200 to 1.

In another embodiment, a wagering field such as that shown in FIG. 12 is utilized. The wagering field has single numbers for both a first game ball and a second game ball. The numbered wagering areas are distinguished by color to the several sequential outcomes. Both sets of numbers are optionally displayed in different positions on the wagering field as compared to a conventional Roulette wagering field. Players wager on selected combinations by placing gaming chips on lines separating first game ball and second game ball numbers. Players may also wager on rows and columns of numbers as in conventional Roulette. However, since the rows are mixed with first and second game ball numbers, such row wagers are actually wagers on combinations of first and second outcomes. Unlike the preceding embodiment, players cannot place wagers on independent rows and do not need special marking chips to indicate bet combinations. Each single bet represents a first ball and second ball outcome. Wagers are paid according to the optional pay table of FIG. 13.

As an example of this embodiment, if a player were to place a $5 chip on the wager box for the pair of outcomes "19" and "7", and select an non-sequenced bet, if either the pair of outcomes (19,7), or (7,19) were to be produced, the player would be rewarded at the payout rate of 600 to 1, for a total of $3,000. If, instead, the $5 wager were placed on the "2nd twelve/1st twelve" selected as sequenced, and the results were (19,7), the player would be rewarded at the rate of 7 to 1, for a total of $35. Combinations not listed wagering area would not be available.

In a variation on the preceding embodiment, the additional combination wagers may be made using a chip indicator. Such wagers would not be available within the existing rows or lines.

In a further embodiment, a feature may be added to any of the above embodiments, but particularly the third through eighth embodiments, in which one or more numbers are selected by the house prior to each game or a set of numbers are posted at the game for use during all games. Players may wager on the predefined house number sequence and receive a high reward if that outcome occurs.

While the preceding embodiments presumed that two balls are utilized, it is contemplated that more than two balls may be utilized and that, to accommodate the additional wagers, additional wagering fields may be included to correspond to the number of balls utilized.

As alluded to above, the present game could be played on a mechanical, electrical, electro-mechanical, or video gaming device. For example, one optional embodiment utilizes a conventional mechanical wheel and a dealer. The dealer has an electronic apparatus that has a keypad attached. The apparatus is connected to a "display board" visible to all players and the dealer. Each combination wager in embodiments is verified and recorded by the dealer via the keypad and the display board prior to the game initiation. This enables the dealer and players to manage bets by visually referring to the display board.

In another optional embodiment, an electronic roulette table and a live dealer may be provided. The dealer actuates the Roulette wheel and balls, collects losing wagers, and pays winning wagers. The wagering field is illuminated electronically and may optionally recognize player bets, wins and losses.

Yet another embodiment may include an electronic roulette table and live dealer. The dealer operates the original wheel and balls, collects losing wagers, and pays winning wagers. Players indicate their selections and bets via individual monitor screens and or switch inputs. The physical representations of money (chips, markers, coupons, tickets and cash) are placed in player wager areas near the individual player screen.

Another optional embodiment includes an electronic roulette table and no dealer. The game is a single player unit with a video representation of a roulette wheel and betting selection. The games would accept coin, cash, tickets, coupons, receipts or other forms of money for conversion to stored credits when accepted by the game. When the player has completed betting via switches, buttons, touch screen, or the like, the game will initiate. The video representation of the Roulette wheel spinning the multiple indexed balls will be displayed as will the game outcome as determined by a random number generator. The winning bets will be highlighted graphically and paid as winning credits for the player. At any point, a player may cease play and retrieve their retained credits in cash, scrip, or other form.

In yet another embodiment, the game is a multiplayer unit with individual bet stations and a central video representation of a roulette wheel utilizing multiple index balls. Each individual player station includes a coin acceptor or money validation unit, which may be networked to a central unit. The money that have been accepted and credited to each player are converted to credits for betting. Each individual player station also has a video and/or switch bank area for directing wagering. The player is allowed to bet during a wagering period. A predetermined count down will signal the end of the wagering period, disabling the ability to place more bets and allowing the game to begin. A video representation of the Roulette wheel and multiple balls results in at least a first and second outcome. Each winning player will be credited for any winning bets and decremented for any losing bets at the end of each game. The winning bets per player may optionally be identified graphically at the individual player stations.

In a variation on the preceding embodiment, a plurality of player stations is provided but there is no central video representation of the wheel. Rather, the central representation is an electronically operated mechanical wheel, which contains electronic intelligence capable of determining the first and second outcomes.

While certain embodiments of the present invention have been shown and described it is to be understood that the present invention is subject to many modifications and changes without departing from the spirit and scope of the claims presented herein.

I claim:

1. An improved method for conducting a game of roulette for one or more players, in which the random indexing of a ball determines a roulette outcome, comprising: physical roulette game apparatus for game play for each game, each player selecting at least one wager set, said wager set including one or more distinct potential roulette outcomes, and placing a second chance wager;

for each wager set selected, said player electing whether to treat said wager set as ordered and, if said player elects to treat said wager set as ordered, said player designating an order for the potential roulette outcomes of said wager set;

for each game, generating a sequenced, non-repetitive, outcome set of n roulette outcomes, where $n \geqq 2$;

if said player has elected to treat said wager set as ordered, comparing the outcome set to said wager set and, if the roulette outcomes of said wager set in the order designated appear in the outcome set in the sequence generated, issuing a payout to said player;

if said player has elected to treat said wager set as unordered, comparing the outcome set to said wager set and, if the outcomes of said wager set appear in the outcome set, without regard to the sequence generated, issuing a payout to said player; and if a roulette outcome of said selected wager set is not generated as the first outcome of said generated outcome set, but is generated in a specified position of said generated outcome set, issuing a payout on the player's second chance wager.

2. The improved method of claim 1 wherein said wager set further comprises multiple, ordered, equal, wagers on a single roulette outcome, in differing ordinal positions in said sequenced outcome set, and where payout on said single roulette outcome occurs when the selected single roulette outcome appears in said outcome set, the size of the payout depending upon the ordinal position of the single roulette outcome within said outcome set.

3. The improved method of claim 2 wherein said wager set further comprises wagers on independent outcomes 1 thru p, where $1 \leqq p \leqq n$, said wagers placed on one or more selected outcome, each said outcome wagers separately compared to said outcome set and rewarded with a payout if said selected outcome appears in said outcome set without regard to whether any other selected outcomes appear in said outcome set.

4. The improved method of claim 1 wherein said wager set further comprises wagers on ordered q-tuples of outcomes, where $1 \leqq q \leqq n$, said q-tuple of outcomes being compared to said outcome set and, if the q-tuple of outcomes occurs in order rewarding said q-tuple wager with a reward that varies with q.

5. An improved roulette game for one or more players, comprising: physical roulette game apparatus for game play for each game, each player selecting one or more wager sets, each said wager set including one or more distinct outcomes, and placing a second chance wager;

for each wager set selected, said player electing whether to treat said wager set as ordered;

providing a wagering field on which a player places a wager specifying a wager set, amount of wager for each wager set, and ordering election;

for each game, generating outcome sets of two or more non-repetitive, sequenced, outcomes;

for each game, comparing each wager set to said outcome set and, if said player has elected to treat said wager set as ordered, comparing the sequence of elements of said wager set and said outcome set;

for ordered wager sets, if the outcomes of said wager set in the order designated appear in the outcome set in the sequence generated, designating said wager set to be a winning wager set, otherwise designating the wager set to be a losing wager set;

for unordered wager sets, if the outcomes of said wager set appear in the outcome set, without regard to the sequence generated, designating said wager set to be a winning wager set, otherwise designating the wager set to be a losing wager set;

for each losing wager set, collecting wagers;

for each winning wager set, issuing a payout; and if an outcome of said selected wager set is not generated as the first outcome of said generated outcome set, but is generated in a specified position of said generated outcome set, issuing a payout on the player's second chance wager.

6. The improved method of claim 5 wherein said wagering field provides separate areas for wagers on distinct outcomes at each ordinal position within the sequenced outcome set.

7. The improved method of claim 5 wherein said wager set further comprises multiple, ordered, equal, wagers on a single roulette outcome, in differing ordinal positions in said sequenced outcome set, and where payout on said single roulette outcome occurs when the selected single roulette outcome appears in said outcome set, the size of the payout depending upon the ordinal position of the single roulette outcome within said outcome set.

8. The improved method of claim 7 wherein said wagering field provides separate areas for wagers on independent wagers on the outcome at each ordinal position within the sequenced outcome set.

9. The improved method of claim 5 wherein said wager set further comprises wagers on independent outcomes 1 thru p, where $1 \leqq p \leqq n$, said wagers placed on one or more selected outcomes, each said independent outcome wagers separately compared to said outcome set and rewarded with a payout if said selected outcome appears in said outcome set without regard to whether any other selected outcomes appear in said outcome set.

10. The improved method of claim 9 wherein said wagering field provides separate areas for wagers on separate wagers on the outcome at each ordinal position within the sequenced outcome set.

11. The improved method of claim 5 wherein said wager set further comprises wagers on ordered q-tuples of outcomes, where $1 \leqq q \leqq n$, said q-tuple of outcomes being compared to said outcome set and, if the q-tuple of outcomes occurs in order rewarding said q-tuple wager with a reward that varies with q.

12. The improved method of claim 11 wherein said wagering field provides separate areas for wagers on separate wagers on the outcome at each ordinal position within the sequenced outcome set.

13. The improved method of claim 11 wherein said wagering field provides separate areas for independent wagers on each ordered outcome within the outcome set, subsets of said outcome sets, entire outcome sets, and election of ordering option.

* * * * *